US007056579B2

(12) United States Patent
Sakamoto et al.

(10) Patent No.: US 7,056,579 B2
(45) **Date of Patent: *Jun. 6, 2006**

(54) HIGH-STRENGTH POLYETHYLENE FIBER

(75) Inventors: Godo Sakamoto, Shiga (JP); Syoji Oda, Shiga (JP); Yoshihiko Teramoto, Shiga (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/486,110

(22) PCT Filed: Aug. 2, 2002

(86) PCT No.: PCT/JP02/07910

§ 371 (c)(1),
(2), (4) Date: Aug. 6, 2004

(87) PCT Pub. No.: WO03/014437

PCT Pub. Date: Feb. 20, 2003

(65) Prior Publication Data

US 2005/0003182 A1 Jan. 6, 2005

(30) Foreign Application Priority Data

Aug. 8, 2001 (JP) ..... 2001-241118

(51) Int. Cl.
*D01F 6/00* (2006.01)

(52) U.S. Cl. ..... 428/364; 428/394

(58) Field of Classification Search ..... 428/364, 428/394

See application file for complete search history.

(56) References Cited

U.S. PATENT DOCUMENTS

| | | | | | |
|---|---|---|---|---|---|
| 4,228,118 | A | | 10/1980 | Wu et al. | |
| 4,276,348 | A | * | 6/1981 | Wu et al. | 428/33 |
| 5,036,148 | A | * | 7/1991 | Chanzy et al. | 526/169.2 |
| 5,272,236 | A | * | 12/1993 | Lai et al. | 526/348.5 |
| 5,474,845 | A | * | 12/1995 | Turunen et al. | 428/364 |
| 6,272,236 | B1 | * | 8/2001 | Pierrat et al. | 382/144 |
| 6,605,348 | B1 | * | 8/2003 | Ohta et al. | 428/364 |
| 6,770,362 | B1 | * | 8/2004 | Okano | 428/357 |
| 6,770,363 | B1 | * | 8/2004 | Konishi et al. | 428/357 |

FOREIGN PATENT DOCUMENTS

| | | |
|---|---|---|
| CA | 1152272 | 8/1983 |
| JP | 39-12859 | 7/1964 |
| JP | 60-047922 | 10/1985 |
| JP | 64-008732 | 2/1989 |
| JP | 08-504891 | 5/1996 |
| WO | WO 93/08221 | 4/1993 |
| WO | WO 93/24686 | 12/1993 |

* cited by examiner

*Primary Examiner*—N. Edwards
(74) *Attorney, Agent, or Firm*—Morrison & Foerster LLP

(57) ABSTRACT

A high strength polyethylene filament having tenacity of at least 15 cN/dTex, which comprises a polyethylene having a weight-average molecular weight of 300,000 or less and a ratio of a weight-average molecular weight to a number-average molecular weight (Mw/Mn) of 4.0 or less as determined in a state of the filament, and containing 0.01 to 3.0 branched chains per 1,000 backbone carbon atoms. When cut fibers are obtained by cutting the polyethylene filament, a rate of dispersion-defective fibers is 2.0% or less.

8 Claims, No Drawings

HIGH-STRENGTH POLYETHYLENE FIBER

FIELD OF THE INVENTION

The present invention relates to a novel polyethylene filament with high strength which can be applied to a wide range of industrial fields such as high performance textiles for a variety of sports clothes, bulletproof or protective clothing, protective gloves, and a variety of safety goods; a variety of ropes (tug rope, mooring rope, yacht rope, construction rope, etc.); fishing threads; braided ropes.(e.g., blind cable, etc.); nets (e.g., fishing nets, ground nets, etc.); reinforcing materials for chemical filters, battery separators, capacitors and nonwoven cloths; canvas for tents; reinforcing fibers for sports goods (e.g., helmets, skis, etc.), speaker cones and composites (e.g., prepreg, etc.); and reinforcing fibers for concrete, etc.

BACKGROUND OF THE INVENTION

As a polyethylene filament with high strength, there is known a filament which is produced from an ultra-high molecular weight polyethylene by a so-called gel-spinning method and which has such a high strength and such a high elastic modulus that any of conventional filaments has never possessed, as disclosed in, JP-B-60-47922, and this filament has already come into industrially wide use.

JP-B-64-8732 discloses a filament which is made from an ultra-high molecular weight polyethylene having a weight-average molecular weight of at least 600,000 as a starting material by so-called "gel spinning method" and which has a higher strength and a higher elastic modulus than any of conventional filaments.

A high strength polyethylene filament produced by melt spinning is disclosed in, for example, U.S. Pat. No. 4,228,118. According to this patent, the high strength polyethylene filament disclosed is obtained by extruding a polyethylene having a number-average molecular weight of at least 20,000 and a weight-average molecular weight of less than 125,000 through a spinneret which is maintained at the temperature between 220 and 335° C., then taking over the polymer at the rate of at least 30 m/min. followed by drawing it at least 20 times at the temperature between 115 and 132° C. Thus the filament has a tenacity of at least 10.6 cW/dTex.

Moreover, JP-A-08-504891 discloses a high strength polyethylene filament which is produced by melt spinning polyethylene with high density through a spinneret, cooling the filament coming out from the spinneret, and then drawing the obtained fiber at the temperature of 50–150 C.

Since a high strength polyethylene filament by gel spinning was invented, the filament has been used in all fields, and the physical properties required for the high strength polyethylene filament as a raw material became still higher in recent years. In order to deal with a wide range use, i.e. to satisfy the required performance which accompanies each use, it is required to fulfill simultaneously that in any monofilament fineness, a filament should excel in mechanical strength and an elastic modulus, the filament should be uniform, and also there should be no fusion between each monofilament, etc. For example, as far as applications such as battery separators are concerned, a high strength polyethylene filament with small single yarn fineness is desired. By contrast, for ropes or nets with which a fuzz, a rubbing and the like (a so-called wear resistance) pose a problem, the one where single yarn fineness is to some extent thicker conversely is desirable.

Although it is tried to produce a high strength polyethylene filament by the so-called melt spinning, a high strength polyethylene filament which satisfies all the above-mentioned performances has not yet been obtained. It is possible to obtain a high strength polyethylene filament by using gel spinning on the other hand. However, due to the fact that a high strength polyethylene filament with a low monofilament fineness obtained with gel spinning had many fusions and press-stickings between each monofilament, the fiber fused and stuck by pressure became thickness nonuniformity to be a defect so that such a problem as a deterioration of the physical properties of a nonwoven fabric arose when this filament was used for a nonwoven fabric particularly with a low weight (METSUKE). Moreover, when the apparent diameter of the filament became thick caused by the filament fused and stuck by pressure, there was a problem such that the retention of knot strength and loop strength falls.

SUMMARY OF THE INVENTION

The present inventors assume that the following are the causes for the foregoing problems. In the melt spinning, the polymer has many intertwines of molecular chains therein, and therefore, the polymer extruded from a nozzle can not be sufficiently drawn. Further, it is practically impossible to use for the reason of improving strength a polymer having such an ultra-high molecular weight of more than 1,000,000 in the melt spinning because the melt viscosity of the polymer is too high. Therefore, the resultant filament has a low strength. On the other hand, there is a gel spinning method mentioned above where a polyethylene having an ultra-high molecular weight of more than 1,000,000. However, this method has the following problems. The spinning and drawing tensions for obtaining a filament becomes higher, and the use of a solvent for spinning and the drawing of a filament at a temperature higher than the melting point of the filament cause fusions and press-stickings in the filaments. Thus, a desired filament having a uniform fineness can not be obtained. Moreover, when gel spinning was used, it was easy to produce the nonuniformity of fiber presumed to originate in spinning unstable phenomena, such as resonance, in the longitudinal direction, and thus there was a problem in respect of uniformity. The present inventors have succeeded in obtaining a polyethylene filament having a high strength which the melt spinning and the gel spinning in the art could not achieve, and thus accomplished the present invention.

The present invention provides a high strength polyethylene filament having a tenacity of at least 15 cN/dTex, which comprises a polyethylene having a weight-average molecular weight of 300,000 or less and a ratio of a weight-average molecular weight to a number-average molecular weight (Mw/Mn) of 4.0 or less as determined in a state of the filament, and containing 0.01 to 3.0 branched chains per 1,000 backbone carbon atoms.

The present invention also provides a high strength polyethylene filament, wherein the branched chain is an alkyl group containing at least 5 carbon atoms, wherein said filament has an elastic modulus of at least 500 cN/dTex, or wherein a rate of dispersion-defective fibers cut from the filament is 2.0% or less.

DETAILED DESCRIPTION OF THE INVENTION

The present invention is explained in full detail below.

In the process for producing a filament according to the present invention, it is necessary to employ a novel and deliberate process. For example, the following process is recommended; however, this process should not be construed as limiting the scope of the present invention in any way.

Polyethylene referred to in the context of the present invention is a polyethylene of which the repeating unit is substantially ethylene, or it may be copolymerized with a small amount of other monomer such as an α-olefin. Surprisingly, the following features are given to this filament when the branch with a long chain is introduced to some extent by using α-olefin. It was surprisingly found by the inventors that press-sticking which takes place with the pressure brought at the time of cutting fibers could be reduced by making the main chain hold a certain amount of branches. The detailed reason may be assumed as follows for example, although it is not certain. A high strength polyethylene filament is essentially hard to be cut since molecular chains are highly oriented and thus crystallized in the direction of a fiber axis. When cutting such a high strength polyethylene filament, press-sticking of the filament tend to takes place since a pressure is brought to the filament at the time of cutting. It is assumed that by putting the branch with a long chain to some extent to a main chain, not to mention the fiber itself becoming soft, the portion of the branched chain becomes amorphous so that the pressure at the time of cutting is reduced and thus press-sticking at the time of a cutting decreases. However, if the quantity of long chain branch increases too much, it becomes a defect and the strength of fiber falls. Therefore, it is desirable that alkyl groups containing at least 5 carbon atoms are present as branched chains at a rate of 0.01 to 3.0 per 1,000 backbone carbon atoms from a viewpoint of obtaining a filament with high strength and a high elastic modulus. Preferably, the rate ranges from 0.05 to 2, more preferably from 0.1 to 1 per 1,000 backbone carbon atoms.

Also, it is important that the polyethylene in the state of a filament has a weight-average molecular weight of 300,000 or less, and that the ratio of a weight-average molecular weight to a number-average molecular weight (Mw/Mn) becomes 4.0 or less. Preferably, it is important that a weight-average molecular weight in the state of filament is 250,000 or less, and that the ratio of a weight-average molecular weight to a number-average molecular weight (Mw/Mn) becomes 3.5 or less. Still more preferably, a weight-average molecular weight in the state of a filament is 200,000 or less, and that the ratio of a weight-average molecular weight to a number-average molecular weight (Mw/Mn) becomes 3.0 or less.

When a polyethylene of a degree of polymerization with which a weight-average molecular weight of the polyethylene in the state of a filament exceeds 300,000 is used as a raw material, the melt viscosity becomes very high, and therefore, the melt molding thereof becomes very hard. In addition, when the ratio of the weight-average molecular weight to the number-average molecular weight of the polyethylene in the state of a filament is at least 4.0, this polyethylene filament is lower in the largest draw ratio in drawing and also lower in strength, as compared with a case using a polymer having the same weight-average molecular weight. The reasons therefor may be assumed that the molecular chain with long relaxing time can not be fully drawn in the drawing step and finally breaks, and that its wider molecular weight distribution permits the amount of a component with a lower molecular weight to increase to thereby increase the number of the molecular ends, which lowers the strength of the resultant filament, as compared with a polyethylene having the same weight-average molecular weight. In addition, the polymer may be intentionally deteriorated in the step of melt extrusion or spinning so as to control the molecular weight and the molecular weight distribution of the polyethylene in the state of a filament; or otherwise, a polyethylene having, a narrow molecular weight distribution may be used.

In the method preferable for the present invention polyethylene mentioned above is melt-extruded by an extruder, quantitatively discharged through a spinneret with a gear pump. The resultant threadlike polyethylene is then quenched with a cooled air, and drawn at a predetermined speed. In the drawing step, it is important that the threadlike polyethylene is drawn quickly enough. In other words, it is important that the ratio of the discharge linear speed to the winding speed is at least 100, preferably at least 150, more preferably at least 200. This ratio can be calculated from the diameter of the mouthpiece, the discharge amount from a single hole, the polymer density in the molten state, and the winding speed. Thus, since no solvent is used, the process of which is different from gel-spinning, when a round spinneret is used, the cross section of the filament becomes round in shape and thus press-sticking is hard to be generated even under a tension at spinning and drawing.

It is preferable to employ the drawing method further shown below for obtaining the filament according to the present invention in addition to the above-mentioned spinning conditions.

Thus, it was found that the physical properties of a filament were surprisingly improved by drawing the filament at a temperature which is less than the α-relaxation temperature of the filament, specifically less than 65° C. and then further drawing at a temperature which is higher than the α-relaxation temperature of the filament and lower than the melting point of the same filament, specifically more than 90° C. The generation of fusion and press-sticking of fiber is effectively prevented by drawing at a temperature which is lower than the melting point of the filament. In this case the filament may be drawn further in multi-stages.

In the present invention, a predetermined fiber was obtained by fixing the speed of the first set of a godet roller with 5 m/min, whereas varying the speed of the other godet rollers on the occasion of the drawing process.

Hereinafter, the method of measurement and the measuring conditions for finding the characteristic values according to the present invention are explained below.

(Tenacity and Elastic Modulus)

The tenacity and the elastic modulus of a sample, of the present invention, with a length of 200 mm (the distance between each of chucks) were measured as follows. The sample was drawn at a drawing speed of 100%/min., using "Tensilon" (Orientic Co., Ltd.). A strain-stress curve was recorded under an atmosphere of a temperature of 20° C. and a relative humidity of 65%. The tenacity of the sample (cN/dTex) was calculated from a stress at the breaking point of the curve, and the elastic modulus (cN/dTex) was calculated from a tangent line which shows the largest gradient at or around the origin of the curve. The respective values were measured 10 times, and the 10 measured values were averaged.

(Weight-Average Molecular Weight Mw, Number-Average Molecular Weight Mn and Ratio of Mw/Mn)

The values of the weight-average molecular weight Mw, the number-average molecular weight Mn, and the ratio of Mw/Mn were measured by gel permeation chromatograph (GPC). As the apparatus for GPC, GPC 150C ALC/GPC (manufactured by Waters) equipped with one column (GPC UT802.5 manufactured by SHODEX) and two columns (UT806M) was used. As a solvent for use in measurement, o-dichlorobenzene was used, and the temperature of the columns was set at 145° C. The concentration of the sample was 1.0 mg/ml, and it was measured by injecting 200 μl of the sample. The calibration curve of the molecular weight was found by the universal calibration method, using a polystyrene sample having a known molecular weight.

(Measurement of Branch)

The branch of an olefin polymer is determined by using 13 C-NMR (125 MHz). The measurement was performed using Randall's method described in Rev. Macromol. Chem. Phys., C29 (2&3), pp.285–297.

(Dynamic Viscoelasticity Measurement)

Dynamic viscosity measurement in the present invention was performed using the "Reo-Vibron DDV-01FP type" (manufactured by Orientic Co., Ltd.). Filaments are divided or doubled so as to become 100 deniers ±10 deniers as a whole, with making the arrangement of each monofilament as uniformly as possible, both the ends of fiber being wrapped in aluminum foil and pasted up by the cellulosic adhesive so that a measurement length (distance between metallic chucks) may be set to 20 mm. The overlap width in this case may be about 5 mm in consideration of fixation with metallic chucks. Each specimen was carefully installed to the metallic chucks set as an initial width of 20 mm so that the fiber might not be slackened or twisted. This experiment was conducted after giving a preliminary modification for several seconds under the temperature of 60° C., and the frequency of 110 Hz beforehand. In this experiment, temperature distribution was determined on the frequency of 110 Hz from the low temperature side at the increasing rate of about 1° C/min. for the temperature span between −150° C. to 150° C. In the measurement, a static load was set as 5 gf, and the automatic regulation of the sample length was carried out so that fiber might not slacken. The amplitude of dynamic modification was set as 15 micrometers.

(Ratio of a Discharge Linear Speed and a Spinning Speed (Draft Ratio))

A draft ratio (Ψ) is given by the following formula. Draft ratio (Ψ)=a spinning speed (Vs)/a discharge linear speed (V)

Best Mode for Carrying Out the Invention

EXAMPLE 1

A high density polyethylene which had a weight-average molecular weight of 115,000 and a ratio of the weight-average molecular weight to a number-average molecular weight of 2.3 and contained branched chains with at least 5 carbon atoms in a number of 0.4 per 1,000 backbone carbon atoms was extruded through a spinneret having 30 holes with diameters of 0.8 mm so that the polyethylene could be discharged at 290° C. and at a rate of 0.5 g/min. per hole. The threadlike polyethylene extruded is allowed to pass through a thermally insulating zone with a length of 15 cm and then quenched at 20° C. and 0.5 m/s, and wound up at a speed of 300 m/min. This non-drawn filament was drawn with at least two sets of temperature controllable Nelson rollers. The drawing in the first stage was carried out at 25° C. to a length 2.8 times longer. The filament was further heated to 115° C. and was drawn to a length seven times longer. The physical properties of the resultant drawn filament are shown in Table 1.

EXAMPLE 2

The drawn filament of Example 1 was heated to 125° C. and was drawn to a length 1.3 times longer. The physical properties of the resultant filament are shown in Table 1.

EXAMPLE 3

A drawn filament was produced substantially in the same manner as in Example 1, except that the drawing temperature in the first stage was changed to 40° C. The physical properties of the resultant filament are shown in Table 1.

EXAMPLE 4

A drawn filament was produced substantially in the same manner as in Example 1, except that the drawing temperature in the first stage was changed to 10° C. The physical properties of the resultant filament are shown in Table 1.

EXAMPLE 5

A drawn filament was obtained substantially in the same manner as in Example 1, except that a high density polyethylene having a weight-average molecular weight of 152,000 and a ratio of the weight-average molecular weight to a number-average molecular weight of 2.4 and contained branched chains with at least 5 carbon atoms in a number of 0.4 per 1,000 backbone carbon atoms was extruded at 300° C. through a spinneret having 30 holes with diameters of 0.9 mm so that the polyethylene could be discharged at 0.3 g/min. per hole. The physical properties of the resultant filament are shown in Table 1.

EXAMPLE 6

A high density polyethylene which had a weight-average molecular weight of 175,000 and a ratio of the weight-average molecular weight to a number-average molecular weight of 2.4 and contained branched chains with at least 5 carbon atoms in a number of 0.4 per 1,000 backbone carbon atoms was extruded through a spinneret having 30 holes with diameters of 1.0 mm so that the polyethylene could be discharged at 300° C. and at a rate of 0.8 g/min. per hole. The threadlike polyethylene extruded is allowed to pass through a thermally insulating zone with a length of 15 cm and then quenched at 20° C. and 0.5 m/s, and wound up at a speed of 150 m/min. This non-drawn filament was drawn with at least two sets of temperature controllable Nelson rollers. The drawing in the first stage was carried out at 25° C. to a length 2.0 times longer. The filament was further heated to 115° C. and was drawn to a length 4.0 times longer. The physical properties of the resultant drawn filament are shown in Table 1.

Comparative Example 1

A drawn filament was produced substantially in the same manner as in Example 1, except that the drawing temperature at the first stage was changed to 90° C. The physical properties of the resultant filament are shown in Table 2.

Comparative Example 2

A drawn filament was produced substantially in the same manner as in Example 1, except that the spinning speed was changed to 60 m/min, the drawing temperature in the first stage was changed to 90° C., the draw ratio at the first and the second stage were changed to 3.0 and 7.0 respectively. The physical properties of the resultant filament are shown in Table 2.

Comparative Example 3

A drawn filament was produced substantially in the same manner as in Example 1, except that the spinning speed was changed to 60 m/min, the drawing temperature at the first stage was changed to 63° C., the draw ratio at the first and the second stage were changed to 3.0 and 7.0 respectively. The physical properties of the resultant filament are shown in Table 2.

Comparative Example 4

A drawn filament was obtained substantially in the same manner as in Example 1, except that a high density polyethylene having a weight-average molecular weight of 123,000 and a ratio of the weight-average molecular weight to a number-average molecular weight of 2.5 and contained branched chains with at least 5 carbon atoms in a number of 12 per 1,000 backbone carbon atoms was used. However, the filament was frequently broken during the drawing and only a filament drawn with a lower draw ratio was obtained. The physical properties of the resultant filament are shown in Table 2.

Comparative Example 5

A non-drawn filament was obtained substantially in the same manner as in Example 1, except that a high density polyethylene having a weight-average molecular weight of 121,500 and a ratio of the weight-average molecular weight to a number-average molecular weight of 5.1 and contained branched chains with at least 5 carbon atoms in a number of 0.4 per 1,000 backbone carbon atoms was extruded through a spinneret having 30 holes with diameters of 0.8 mm so that the polyethylene could be discharged at 270° C. and at a rate of 0.5 g/min. per hole. This non-drawn filament was drawn at 90° C. to a length 2.8 times longer. After that, the filament was further heated to 115° C. and was drawn to a length 3.8 times longer. The physical properties of the resultant drawn filament are shown in Table 2.

Comparative Example 6

The non-drawn filament obtained in Comparative Example 4 was drawn at 40° C. to a length 2.8 times longer. After that, the filament was further heated to 115° C. and was drawn to a length 4.0 times longer. The physical properties of the resultant drawn filament are shown in Table 2.

Comparative Example 7

A non-drawn filament was produced substantially in the same manner as in Example 1, except that the spinning speed was changed to 80 m/min. This non-drawn filament was drawn at 80° C. to a length 2.8 times longer. After that, the filament was further heated to 115° C. and was drawn to a length 4.0 times longer. The physical properties of the resultant drawn filament are shown in Table 3.

Comparative Example 8

A non-drawn filament was obtained substantially in the same manner as in Example 1, except that a high density polyethylene having a weight-average molecular weight of 123,000 and a ratio of the weight-average molecular weight to a number-average molecular weight of 6.0 and contained branched chains with at least 5 carbon atoms in a number of 0 per 1,000 backbone carbon atoms was extruded through a spinneret having 30 holes with diameters of 0.8 mm so that the polyethylene could be discharged at 295° C. and at a rate of 0.5 g/min. per hole. This non-drawn filament was drawn at 90° C. to a length 2.8 times longer. After that, the filament was further heated to 115° C. and was drawn to a length 3.7 times longer. The physical properties of the resultant drawn filament are shown in Table 3.

Comparative Example 9

A non-drawn filament was obtained substantially in the same manner as in Example 1, except that a high density polyethylene having a weight-average molecular weight of 52,000 and a ratio of the weight-average molecular weight to a number-average molecular weight of 2.3 and contained branched chains with at least 5 carbon atoms in a number of 0.6 per 1,000 backbone carbon atoms was extruded through a spinneret having 30 holes with diameters of 0.8 mm so that the polyethylene could be discharged at 255° C. and at a rate of 0.5 g/min. per hole. This non-drawn filament was drawn at 40° C. to a length 2.8 times longer. After that, the filament was further heated to 100° C. and was drawn to a length 5.0 times longer. The physical properties of the resultant drawn filament are shown in Table 3.

Comparative Example 10

A spinning was conducted by using a high density polyethylene having a weight-average molecular weight of 820,000 and a ratio of the weight-average molecular weight to a number-average molecular weight of 2.5 and contained branched chains with at least 5 carbon atoms in a number of 1.3 per 1,000 backbone carbon atoms. However, the melt viscosity of the polymer was too high and the polymer could not be extruded uniformly.

Comparative Example 11

A slurry-like mixture of an ultra-high molecular weight polyethylene having a weight-average molecular weight of 3,200,000 and a ratio of the weight-average molecular weight to a number-average molecular weight of 6.3 (10 wt.%) and decahydronaphthalene (90 wt.%) was dispersed and dissolved with a screw type kneader set at 230° C., and was fed to a mouthpiece which had 2000 holes with diameters of 0.2 mm and was set at 170° C., using a weighing pump, so that the polyethylene could be discharged at 0.08 g/min. per hole. A nitrogen gas adjusted to 100° C. was fed at a rate of 1.2 m/min. from a slit-like gas-feeding orifice arranged just below a nozzle, and such a nitrogen gas was blown against the filament as uniformly as possible so as to evaporate off decalin from the surface of the non-drawn filament. Immediately after that, the non-drawn filament was substantially cooled with the airflow set at 30 degrees. The non-drawn filament was drawn at a rate of 50 m/min. with Nelson-like-arranged rollers which were set on the side of downstream from the nozzle. At this stage, the solvent contained in the filament was reduced to about half of the original weight. The resultant filament was subsequently drawn to a length 3 times longer, in an oven set at 100° C. The filament was, subsequently drawn to a length 4.6 times longer, in an oven heated to 149° C. The resultant filament was uniform and it could be obtained without any breakage. The physical properties of the resultant filament are shown in Table 3.

Comparative Example 12

The slurry-like mixture prepared substantially in the same manner as in Comparative Example 11 was dissolved with a screw type kneader set at 230° C., and was fed to a mouthpiece which had 500 holes with diameters of 0.8 mm and was set at 180° C., using a weighing pump, so that the polyethylene could be discharged at 1.6. g/min. per hole. A nitrogen gas adjusted to 100° C. was fed at a rate of 1.2 m/min. from a slit-like gas-feeding orifice arranged just below a nozzle, and such a nitrogen gas was blown against the filament as uniformly as possible so as to evaporate off decalin from the surface of the non-drawn filament. After that, the non-drawn filament was drawn at a rate of 100 m/min. with Nelson-like-arranged rollers which were set on the side of downstream from the nozzle. At this stage, the solvent contained in the filament was reduced to about 60 wt. % of the original weight. The resultant filament was subsequently drawn to a length 4.0 times longer, in an oven set at 130° C. The filament was subsequently drawn to a length 3.5 times longer, in an oven heated to 149° C. The resultant filament was uniform and it could be obtained without any breakage. The physical properties of the resultant filament are shown in Table 3.

TABLE 1

| | | Example 1 | Example 2 | Example 3 | Example 4 | Example 5 | Example 6 |
|---|---|---|---|---|---|---|---|
| Weight-Average Molecular Weight (polymer) | g/mol | 115000 | 115000 | 115000 | 115000 | 152000 | 175000 |
| Mw/Mn (polymer) | — | 2.3 | 2.3 | 2.3 | 2.3 | 2.4 | 2.4 |
| Branched chains containing at least 5 carbon atoms | /per 1,000 carbon atoms | 0.4 | 0.4 | 0.4 | 0.4 | 0.8 | 0.4 |
| Discharge rate per hole | g/min | 0.5 | 0.5 | 0.5 | 0.5 | 0.3 | 1.2 |
| Spinning speed | m/min | 300 | 300 | 300 | 300 | 200 | 150 |
| Draft ratio | — | 225 | 225 | 225 | 225 | 316 | |
| α-relaxation temperature | ° C. | 63 | 63 | 63 | 63 | 67 | 65 |
| Drawing temperature in the 1st stage | ° C. | 25 | 25 | 40 | 10 | 25 | 25 |
| Draw ratio in the 1st stage | — | 2.8 | 2.8 | 2.8 | 2.8 | 2.4 | 2.0 |
| Drawing temperature in the 2nd stage | ° C. | 115 | 115 | 115 | 115 | 115 | 115 |
| Draw ratio in the 2nd stage | — | 5.0 | 5.0 | 5.0 | 5.0 | 4.8 | 4.0 |
| Drawing temperature in the 3rd stage | ° C. | | 125 | | | | |
| Draw ratio in the 3rd stage | — | | 1.2 | | | | |
| Draw ratio in total | — | 14.0 | 16.8 | 14.0 | 14.0 | 11.5 | 8.0 |
| Weight Average Molecular Weight (filament) | g/mol | 110000 | 110000 | 110000 | 110000 | 138000 | 138000 |
| Mw/Mn (filament) | | 2.2 | 2.2 | 2.2 | 2.2 | 2.3 | 2.3 |
| Fineness | dTex | 36 | 30 | 36 | 36 | 65 | 302 |
| Tenacity | cN/dTex | 18.2 | 19.1 | 17.9 | 18.7 | 18.9 | 15.1 |
| Elastic modulus | cN/dTex | 820 | 880 | 801 | 871 | 820 | 401 |
| Rate of dispersion-defective fibers | % | 1.0 or less | 1.0 or less | 1.0 or less | 1.0 or less | 1.0 or less | 1.0 or less |

TABLE 2

| | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|
| Weight-Average Molecular Weight (polymer) | g/mol | 115000 | 115000 | 115000 | 123000 | 121500 | 121500 |
| Mw/Mn (polymer) | — | 2.3 | 2.3 | 2.3 | 2.5 | 5.1 | 5.1 |
| Branched chains containing at least 5 carbon atoms | /per 1,000 carbon atoms | 0.4 | 0.4 | 0.4 | 12 | 0.8 | 0.4 |
| Discharge rate per hole | g/min | 0.5 | 0.5 | 0.5 | 0.5 | 0.3 | 1.2 |
| Spinning speed | m/min | 300 | 60 | 60 | 300 | 300 | 300 |
| Draft ratio | — | 225 | 45 | 45 | 225 | 225 | 225 |
| α-relaxation temperature | ° C. | 63 | 56 | 56 | 57 | 64 | 64 |
| Drawing temperature in the 1st stage | ° C. | 90 | 90 | 63 | 25 | 90 | 40 |
| Draw ratio in the 1st stage | — | 2.8 | 3.0 | 3.0 | 2.0 | 2.8 | 2.8 |

TABLE 2-continued

| | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|
| Drawing temperature in the 2nd stage | ° C. | 115 | 115 | 115 | 115 | 115 | 115 |
| Draw ratio in the 2nd stage | — | 5.0 | 7.0 | 7.0 | 4.1 | 3.8 | 4.0 |
| Draw ratio in total | — | 14.0 | 21.0 | 21.0 | 8.2 | 10.6 | 11.2 |
| Weight Average Molecular Weight (filament) | g/mol | 110000 | 110000 | 110000 | 116000 | 116000 | 116000 |
| Mw/Mn (filament) | | 2.2 | 2.2 | 2.2 | 2.4 | 4.8 | 4.8 |
| Fineness | dTex | 36 | 119 | 119 | 61 | 47 | 45 |
| Tenacity | cN/dTex | 14.0 | 12.1 | 13.1 | 14.2 | 13.1 | 13.4 |
| Elastic modulus | cN/dTex | 620 | 320 | 380 | 471 | 433 | 440 |
| Rate of dispersion-defective fibers | % | 1.0 or less | 1.0 or less | 1.0 or less | 1.0 or less | 1.0 or less | 1.0 or less |

TABLE 3

| | | Comp. Ex. 7 | Comp. Ex. 8 | Comp. Ex. 9 | Comp. Ex. 10 | Comp. Ex. 11 | Comp. Ex. 12 |
|---|---|---|---|---|---|---|---|
| Weight-Average Molecular Weight (polymer) | g/mol | 121500 | 123000 | 52000 | 820000 | 3200000 | 3200000 |
| Mw/Mn (polymer) | — | 5.1 | 6.1 | 2.3 | 2.5 | 6.3 | 6.3 |
| Branched chains containing at least 5 carbon atoms | /per 1,000 carbon atoms | 0.4 | 0 | 0.6 | 1.3 | 0 | 0 |
| Discharge rate per hole | g/min | 0.5 | 0.5 | 0.5 | | 0.08 | 1.6 |
| Spinning speed | m/min | 80 | 300 | 300 | | 50 | 100 |
| Draft ratio | — | 60 | 225 | 225 | | 18.3 | 29.2 |
| α-relaxation temperature | ° C. | 57 | 64 | 54 | | 82 | 89 |
| Drawing temperature in the 1st stage | ° C. | 80 | 90 | 40 | | 100 | 130 |
| Draw ratio in the 1st stage | — | 2.8 | 2.8 | 2.8 | | 3.0 | 4.0 |
| Drawing temperature in the 2nd stage | ° C. | 115 | 115 | 100 | | 149 | 149 |
| Draw ratio in the 2nd stage | — | 4.0 | 3.7 | 5.0 | | 4.6 | 3.5 |
| Draw ratio in total | — | 11.2 | 10.4 | 14.0 | | 13.8 | 14.0 |
| Weight Average Molecular Weight (filament) | g/mol | 116000 | 116000 | 50000 | | 2500000 | 2650000 |
| Mw/Mn (filament) | | 4.8 | 4.8 | 2.2 | | 5.1 | 5.3 |
| Fineness | dTex | 167 | 48 | 36 | | 209 | 574 |
| Tenacity | cN/dTex | 10.1 | 12.8 | 9.4 | | 27.5 | 30.1 |
| Elastic modulus | cN/dTex | 280 | 401 | 301 | | 921 | 1001 |
| Rate of dispersion-defective fibers | % | 1.0 or less | 1.0 or less | 1.0 or less | | 12.1 | 8.0 |

INDUSTRIAL APPLICABILITY

There can be provided a high strength polyethylene filament which is excellent in Tenacity and elastic modulus in any fineness of monofilament and has uniformity, the filament being free of fusion and press-sticking between each monofilament in addition.

What is claimed is:

1. A high strength polyethylene filament having a tenacity of at least 15 cN/dTex, which comprises a polyethylene having a weight-average molecular weight of 300,000 or less and a ratio of a weight-average molecular weight to a number-average molecular weight (Mw/Mn) of 4.0 or less as determined in a filamentary state, and containing 0.01 to 3.0 branched chains per 1,000 backbone carbon atoms.

2. A high strength polyethylene filament according to claim 1, wherein the branched chains contain at least 5 carbon atoms.

3. A high strength polyethylene filament according to claim 1, wherein said filament has an elastic modulus of at least 500 cN/dTex.

4. A high strength polyethylene filament according to claim 1, wherein a rate of dispersion-defective fibers cut from the filament is 2.0% or less.

5. A high strength polyethylene filament according to claim 2, wherein said filament has an elastic modulus of at least 500 cN/dTex.

6. A high strength polyethylene filament according to claim 2, wherein a rate of dispersion-defective fibers cut from the filament is 2.0% or less.

7. A high strength polyethylene filament according to claim 3, wherein a rate of dispersion-defective fibers cut from the filament is 2.0% or less.

8. A high strength polyethylene filament according to claim 5, wherein a rate of dispersion-defective fibers cut from the filament is 2.0% or less.

* * * * *